United States Patent [19]

Spence et al.

[11] 4,298,231

[45] Nov. 3, 1981

[54] APPARATUS FOR USE IN UNDER-GROUND LONG WALL MINE WORKINGS

[76] Inventors: Adam M. Spence, 19 Riverhead, Sprotborough, Doncaster, Yorkshire; James R. Goff, The Barn House, Brockenhurst, Hampshire, both of England

[21] Appl. No.: 111,631

[22] Filed: Jan. 14, 1980

[30] Foreign Application Priority Data

Dec. 29, 1978 [GB] United Kingdom ..... 50349/78

[51] Int. Cl.[3] ..... E21C 29/10

[52] U.S. Cl. ..... 299/50

[58] Field of Search ..... 299/42, 43, 50, 49; 74/422

[56] References Cited

U.S. PATENT DOCUMENTS

| | | | |
|---|---|---|---|
| 3,594,043 | 7/1971 | Weber et al. | 299/42 |
| 3,790,210 | 2/1974 | Georg | 299/50 |
| 4,037,876 | 7/1977 | Georg | 299/43 |
| 4,190,295 | 2/1980 | Boast | 299/43 |

*Primary Examiner*—William F. Pate, III

*Attorney, Agent, or Firm*—Merriam, Marshall & Bicknell

[57] ABSTRACT

The invention is concerned with underground mining equipment, primarily but not exclusively for the mining of coal by the system known as the "long wall system". Where a coal cutting machine is driven along the wall face by the use of a haulage chain anchored at opposite ends of the face, to avoid the problems associated with the establishment of slack chain behind the machine, take-up means is provided at at least the end of the working from which the machine undergoes a working traverse to remove material from the face. Control means is provided to render said take-up means operative, to take up the slack produced in the chain, during such a working traverse of the cutting machine, and to render the take-up means inoperative, to provide a substantially fixed anchorage on a return traverse of the machine. Preferably such take-up means is provided at both ends of the working.

7 Claims, 3 Drawing Figures

APPARATUS FOR USE IN UNDER-GROUND LONG WALL MINE WORKINGS

BACKGROUND OF THE INVENTION

This invention is concerned with improvement apparatus provided at underground mine workings. The invention has been devised primarily for the underground mining of coal, particularly by the system known as the "long wall" system. It will however be appreciated that the invention may be applied with advantage to the underground mining of other materials. It also relates to an underground mine working per se at which such apparatus is installed.

In an underground coal mine working of the "long wall" type, a coal-cutting machine is conventionally driven along the upright long wall face being worked by the use of a haulage chain which is anchored at opposite ends of the face. The haulage chain passes over a drive sprocket of the machine, and this sprocket is driven by motor means on the machine whereby the machine hauls itself along the face from one end to the other, and back.

The haulage chain is conventionally 22 millimeter chain and a considerable force is applied to the chain during a hauling and cutting operation of the machine; typically this force is in the order of 20 tonf. This force inevitably stretches the chain, and as the machine traverses along the face an increasing length of slack is established in that part of the chain behind, i.e. at the trailing end of the machine, so that when the machine reaches one end of the face there is then a considerable amount of slack chain behind the machine. When, therefore, the machine is operated to cut in in the reverse direction, the drive sprocket of the machine firstly pulls in the chain slack without appreciable resistance, and when all the slack is pulled in, the chain becomes taut and a shock force is applied to the chain, which results in a shock loading not only of the chain but also of the drive sprocket, in floor means and associated parts. Such shock loading is disadvantageous, in that it increases the risk of breakage of the components. Additionally, the initially slack part of the chain tends to "whip" which may cause damage to other parts of the mining equipment, and could be dangerous to operators in the vicinity.

Several suggestions have been made to reduce this problem. One such suggestion is to anchor the chain at opposite ends of the face to spring or hydraulic rams. However, no prior suggestion has been made which significantly reduces the problem, particularly on long faces, and/or on faces which are curved.

SUMMARY OF THE INVENTION

According to this invention there is provided, in or for an underground mine working in which the material to be mined is removed from a face of the working by a cutting machine traversed along the face, the combination of a haulage chain adapted to co-operate with a driven element on the cutting machine, and a fluid-powered take up means located at that end at least of the working from which the machine undergoes a working traverse to remove the material from the face, wherein said take up means serves to take up slack in the haulage chain during such traverse of the face and control means operatively connected to said take-up means is provided for rendering the take up means operative to take up the slack, or inoperative to provide a substantially fixed anchorage in co-ordination with the direction of traverse of the machine.

The invention is especially useful in workings in which a cut is taken in both directions of traverse, and thus where there is a need for a take up device at both ends of the face being worked. It may also be applied, however, to mine workings where a cut is taken in one direction of traverse only, i.e. where the machine has a working traverse in one direction only and is returned to its start position without cutting. In this case a single take up means may be provided at one end of the working only, or if a take up means is provided at the other end (viz, that end from which the machine is returned idle or free-running), this may be still operative but under such power as to produce a lower take up force along the chain.

Preferably the or each such take up means comprises a rotary hydraulic motor and a sprocket driven thereby, the haulage chain extending around said sprocket and operation of the hydraulic motor being effective to take in slack and to exert a pre-tension on the haulage chain. This form of take up means is operative to take up any length of slack i.e. it is not limited in stroke as in a spring or hydraulic ram. The pre-tension should be lower than the force exterted on the haulage chain by the drive sprocket of the cutting machine when the latter is on a working traverse and is preferably between 7 and 15 tonf, conveniently being about 9 tonf.

DETAILED DESCRIPTION OF THE PREFERRED EMBODIMENT

Figure 1:
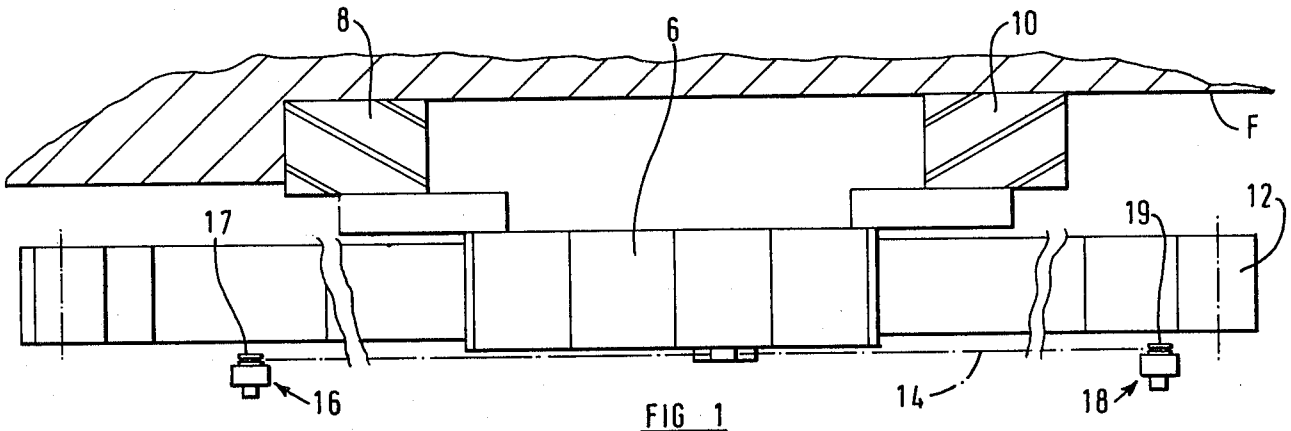
FIG. 1 is a schematic plan view of a mine working which is a preferred embodiment of this invention, illustrating the position of two take up devices in relation to a coal-cutting machine.

In the preferred embodiment of this invention, a coal cutting machine 6 comprising twin cutter drums 8, 10 is mounted above a conveyor assembly 12, for traversing movement longitudinally of and adjacent to a coal face F. Positional control of a haulage chain 14 anchored at opposite ends of the face (at the left and right hand ends of the drawing) is effected by take up means comprising devices 16 and 18 respectively. The haulage chain passes through the housing of the coal cutting machine and through motor means 30 thereof, said motor means comprising two idler sprockets 20,20 and around a driven sprocket 22.

Figure 2:
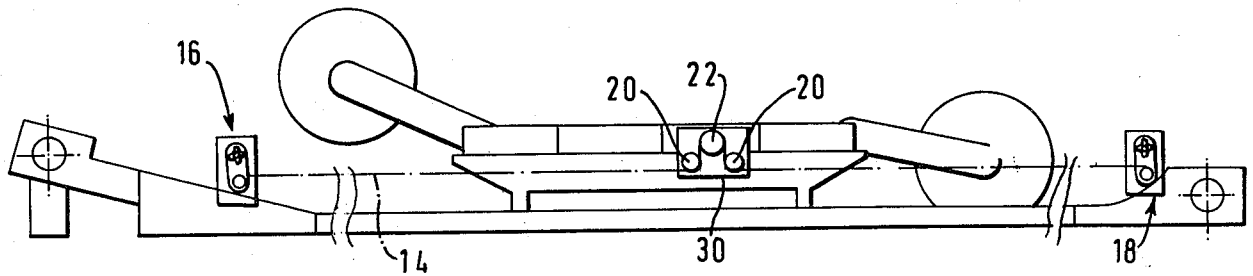
FIG. 2 is a side elevation of FIG. 1.

In a cutting operation of the machine 6, in which it is required to traverse from right to left, the drive sprocket 22 is driven in a clockwise direction as viewed in FIG. 2 and the machine hauls itself along the chain 14 whilst the cutting drum 8 rotates to cut a band of coal from the face F, and to deposit the cut coal on the conveyor 12. During such operation of the drive sprocket 22, slack haulage chain would tend to accumulate to the right of the machine 6.

Conversely, in a cutting operation in which the machine is required to traverse from left to right, the drive sprocket would be driven anti-clockwise as viewed in FIG. 2 and slack haulage chain would tend to accumulate to the left of the machine 6.

Figure 3:
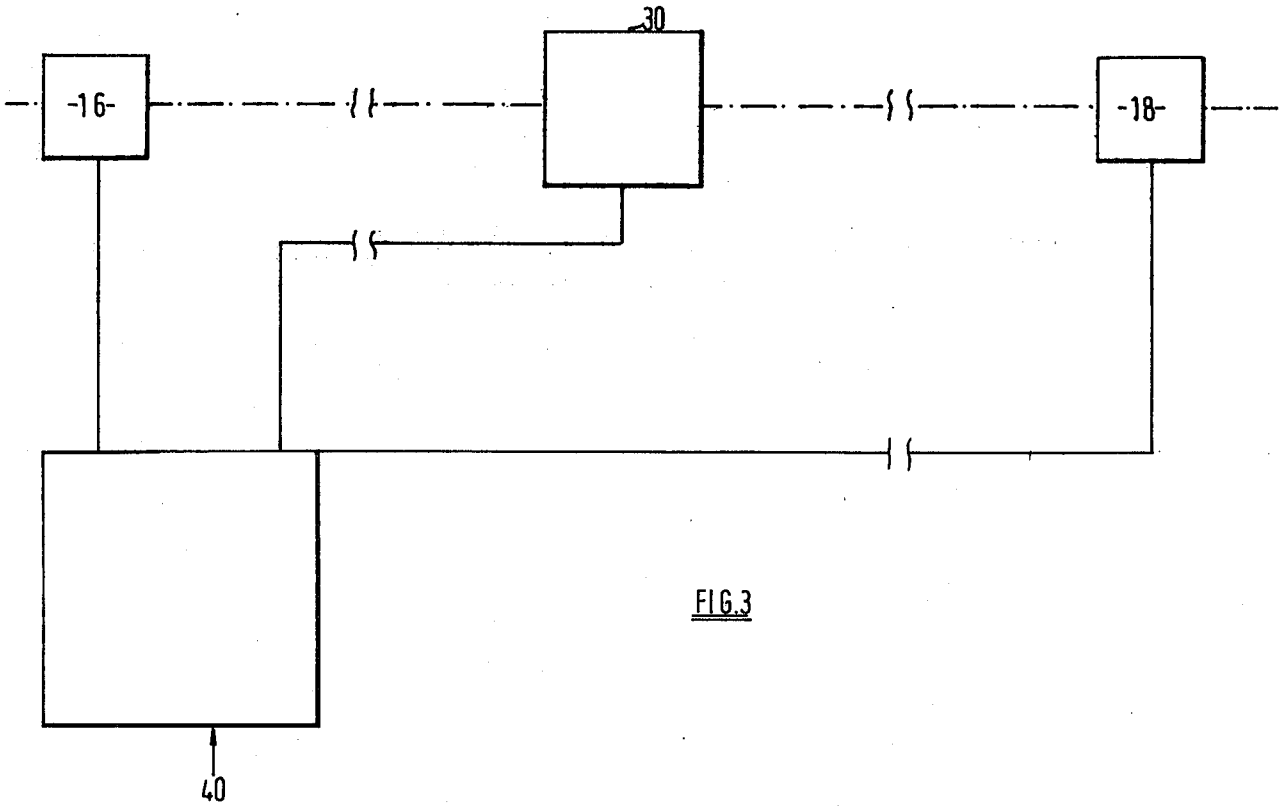
FIG. 3 is a view illustrating schematically a control means of the mine working, and which controls operation of the coal cutting machine and the two take up devices.

Take up devices 16 and 18 respectively comprise drive sprockets 17, 19, over which the haulage chain passes. The take up devices are hydraulically powered, e.g. by respective rotary hydraulic motors, through a control means 40, FIG. 3, which also controls the operation of the cutting machine 6 and the take-up devices 16, 18 in the following manner.

During traverse of the machine 6, from right to left, the control means operates to "lock out" the device 16, rendering the sprocket 17 thereof solid i.e. it will provide substantially positive restraint to any release or pay-out of the chain in response to tension in the latter, thereby providing a fixed anchorage against which the force exerted on the chain 14 by the sprocket 22 (which is in the order of 20 tonf) will act. The control means 40 then initiates operation of the motor means 30, causing the drive sprocket 22 to be rotated to pull the machine along the chain 14, whilst power is also supplied by the motor means to the cutting drum 8. Simultaneously the sprocket 19 of the device 18 is powered to take up the slack chain tending to accumulate to the right of the machine 6, retaining this part of the haulage chain 14 taut under a force of approximately 9 tonf. The extent of take up is limited only by the amount of slack chain created.

When the machine reaches the end of its run (that is reaches the left hand end of the face) and powered traverse of the machine 6 in the left to right direction is commenced under the control of an operator, the control device 18 is locked out, rendering the sprocket 19 thereof solid. The haulage chain between the device 18 and the machine 6, along which the sprocket 22 is about to travel, is at this stage taut under the aforesaid tension of 9 tonf and there is consequently little or no shock loading of the chain, and little or no "whip" thereof when the traverse loading of the order of 20 tonf is established. Simultaneously, the device 16 is powered to rotate the sprocket 17, to apply a tension, typically of approximately 9 tonf, to the length of chain now to the left hand side of the cutting machine 6, taking up any slack which may otherwise come into being as the machine 6 traverses the face towards the right hand end thereof.

It will be appreciated that in underground mine workings in which a cut is taken by the machine in one direction of traverse only (for example in the direction from right to left) and in which return of the machine to its starting position is carried out without there being a coal cutting operation, a considerably lower tension is exerted in the part of the chain to the right of the machine by operation of the sprocket 22. In such circumstances, it may be possible to dispense with the take up device 16 at the left hand end of the face, or to operate this take up device at a lower loading, in view of the smaller amount of slack which would be produced in the chain 14 to the left hand side of the machine 6 during its return traverse.

The control means 40 may be located at a centralised control station, where an operative may effect control over the operation of the control means, or may be mounted on the cutting machine.

The take up devices 16 and 18 may comprise "Staffa" hydraulic motors, and the sprockets 17 and 19 may be in the form of four-toothed sprockets which mesh with the chain 14. As the devices 16 and 18 operate in turn, conveniently slack chain is merely deposited in an adjacent container.

We claim:

1. In or for an underground mine working in which the material to be mined is removed from a face of the working by a cutting machine operative to remove material from the face in each of its opposite directions of traverse therealong, the combination of a haulage chain adapted to co-operate with a drive element on the cutting machine, and a fluid-powered take up means located at each end of the haulage chain by which the machine undergoes a working traverse to remove the material from the face, wherein said take up means serves to take up slack in the haulage chain during such traverse of the face and control means operatively connected to both of said take up means is provided for rendering the take up means operative to take up the slack, or inoperative to provide a substantially fixed anchorage in coordination with the direction of traverse of the machine.

2. The combination according to claim 1 wherein the control means is operative in a manner such that, when one of the take up means is operative, the other is locked out.

3. In or for an underground mine working in which the material to be mined is removed from a face of the working by a cutting machine traversed along the face, the combination of a haulage chain adapted to co-operate with a drive element on the cutting machine, and a fluid-powered take up means located at that end at least of the working from which the machine undergoes a working traverse to remove the material from the face, wherein said take up means serves to take up slack in the haulage chain during such traverse of the face, the take up means comprises a rotary hydraulic motor and a sprocket driven thereby, the haulage chain extending around said sprocket, and control means operatively connected to said take up means for rendering the take up means operative to take up the slack, or inoperative to provide a substantially fixed anchorage in coordination with the direction of traverse of the machine.

4. The combination according to claim 3, wherein the tension in the haulage chain exerted by the or each hydraulic motors, when operative, is between 9 and 15 tonf.

5. The combination according to claim 4, wherein the tension is about 9 tonf.

6. In or for an underground mine working in which the material to be mined is removed from a face of the working by a cutting machine traversed along the face, the combination of a haulage chain adapted to co-operate with a drive element on the cutting machine, and a fluid-powered take up means located at that end at least of the working from which the machine undergoes a working traverse to remove the material from the face, wherein said take up means serves to take up slack in the haulage chain during such traverse of the face, and control means operatively connected to said take up means for rendering the take up means operative to take up the slack, or inoperative to provide a substantially fixed anchorage in coordination with the direction of traverse of the machine, said control means being responsive to a parameter related to the direction of traverse of the cutting machine to lock out of operation the take up means at that end of the face towards which the machine is undergoing a working traverse.

7. The combination according to claim 6 wherein the control means is operatively connected to the drive element of the cutting machine, and controls operation of the cutting machine, direction of traverse thereof across the face, and operation of the take-up means.

* * * * *

UNITED STATES PATENT AND TRADEMARK OFFICE

CERTIFICATE OF CORRECTION

PATENT NO. : 4,298,231

DATED : November 3, 1981

INVENTOR(S) : ADAM MURDOCH SPENCE ET AL

It is certified that error appears in the above-identified patent and that said Letters Patent are hereby corrected as shown below:

On the cover sheet, left column, delete "Foreign Application Priority Data Dec. 29, 1978 [GB] United Kingdom . . . . 50349/78".

Signed and Sealed this

Ninth Day of February 1982

[SEAL]

Attest:

GERALD J. MOSSINGHOFF

Attesting Officer

Commissioner of Patents and Trademarks